US006769693B2

(12) United States Patent
Huard et al.

(10) Patent No.: US 6,769,693 B2
(45) Date of Patent: Aug. 3, 2004

(54) METHOD AND SYSTEM FOR PLAYING A CASINO GAME

(75) Inventors: Marcel Huard, St-Romuald (CA); Réal Bérubé, St-Jean-Chrysostome (CA); Jean-Pierre Bedrossian, Cali (CO); Martin Benoît Gagnon, Lévis (CA)

(73) Assignee: B.C.D. Mécanique Ltée, St-Romuald ( * ) Notice: Subject to any disclaimer, the term of this patent is extended or adjusted under 35 U.S.C. 154(b) by 0 days.

(21) Appl. No.: 09/912,428

(22) Filed: Jul. 26, 2001

(65) Prior Publication Data

US 2003/0071415 A1 Apr. 17, 2003

(51) Int. Cl.[7] ..... A63F 3/08
(52) U.S. Cl. ..... 273/274
(58) Field of Search ..... 273/274, 292

(56) References Cited

U.S. PATENT DOCUMENTS 4,149,728 A * 4/1979 Thompson
4,441,714 A * 4/1984 Goott
4,887,819 A * 12/1989 Walker
6,065,752 A * 5/2000 Beltran
6,302,395 B1 * 10/2001 Astaneha
2001/0015529 A1 * 8/2001 Allen
2002/0190467 A1 * 12/2002 Braun

OTHER PUBLICATIONS

Scarne's New Complete Guide to Gambling, by John Scarne, "Roulette", Published by Sinon & Schuser, New York, pp., 393–398 and 404–407.*

* cited by examiner

*Primary Examiner*—William M. Pierce
(74) *Attorney, Agent, or Firm*—Ogilvy Renault; Isabelle Chabot

(57) ABSTRACT

The present invention relates to an enhanced casino game in which the principles of the standard Roulette game are applied to a standard deck of playing cards. The method and apparatus of the present invention provide an enhanced experience for the player while bringing flexibility in the choice of the casino house income ratio for the casino management team.

23 Claims, 10 Drawing Sheets

METHOD AND SYSTEM FOR PLAYING A CASINO GAME

FIELD OF THE INVENTION

The present invention relates to a method and system for playing a live casino table game. More particularly, the invention relates to a method and system for playing a live casino table game offering new betting options in addition to the wagering options offered in classical roulette casino games and associated with more various and advantageous odds.

BACKGROUND OF THE INVENTION

Casino owners are always interested in introducing new casino games that generate more benefits for the casino house.

More particularly, the game must sustain the interest of the player as long as possible in order to optimize the time spent by the player at the table and his participation in the game.

The Roulette is a very popular table game that is found in almost all casinos. Roulette consists essentially in wagering on at least one number from a plurality of numbers, believing that the wagered number will be randomly drawn from the plurality of numbers. Players make wagers by positioning, on a game surface, some chips, tokens or markers on one or many areas, each area corresponding to one or many betting numbers.

The European Roulette has 37 betting numbers i.e. 1–36 and 0 and the American Roulette has 38 betting numbers i.e. 1–36, 0 and 00.

The game surface forms a rectangular pattern of thirty-six (36) squares laid out in twelve (12) stacked rows, each row having three (3) adjacent squares, each square associated with a particular number from 1 to 36.

A plurality of betting squares are on the edge of the rectangular pattern. One square represents a zero <<0>>, and another square represents a double zero <<00>>. Some squares represent a particular group of numbers arranged in a geometric pattern such as: squares associated with a <<first 12 number block)>>, a <<second 12 number block>> and a <<third 12 number block>>; squares associated with a <<first 12 number column>>, a <<second 12 number column>> and a <<third 12 number column>>. Some squares represent a particular group of 18 numbers such as squares associated with the colors <<red>> or <<black>>; squares associated with <<even>> or <<odd>> parity and squares associated with the numerical ranges of 1 to 18 or 19 to 36.

A player makes his or her bet by placing his positioning markers, chips or tokens at the appropriate place on the playing surface.

A <<straight up>> bet occurs when a player identifies a single number among 0, 00 and 1 to 36 by positioning token, chip or marker on the square associated with the number wagered by the player. A <<split>> bet occurs when the player identifies two numbers by positioning tokens, chips or markers on the border between two squares each one associated to one of the wagered numbers. A <<line>> bet occurs when a player identifies three numbers of a same row by positioning markers on the left border of the first left square of the row of three squares, each square associated with one of the three numbers wagered by the player. A <<square>> bet occurs when a player identifies four numbers in positioning markers on the border cross between the four squares associated to the four selected numbers wagered by the player. A <<street>> bet occurs when a player identifies 6 numbers of two adjacent rows by positioning markers on the border cross formed by the two left borders of the two first left squares of the two adjacent rows and the border between the two first left squares of the two adjacent rows, each of three squares wherein each square of the two adjacent rows is associated with one of the six numbers wagered by the player. A player identifies twelve numbers by positioning markers on one of the squares associated to one of three <<12 card block>>'s or to one of the three <<12 card column>>'s. Finally, a player may identify a particular group of 18 cards in positioning his or her markers on one of the squares associated with the colors <<black>> or <<red>>, the <<even>> or <<odd>> parity or the numerical ranges of 1 to 18 or 19 to 36.

A player chooses his or her betting risk level by making a wager identifying 1, 2, 3, 4, 6, 12 or 18 numbers and consequently, a player chooses his or her level of winning bet payout. For the European and American Roulettes the payout table is as shown in Table 1.

TABLE 1

Payout Table

| Winning | Type Of Event | Bet Pays | N° Of Times The Amount Is Paid | Probability |
|---|---|---|---|---|
| Winning a | Straight Up | Bet Pays | 36 | 35:1 |
| Winning a | Split | Bet Pays | 18 | 17:1 |
| Winning a | Line | Bet Pays | 12 | 11:1 |
| Winning a | Square | Bet Pays | 9 | 8:1 |
| Winning a | Street | Bet Pays | 6 | 5:1 |
| Winning a | 12 Number Block | Bet Pays | 3 | 2:1 |
| Winning a | 12 Number Column | Bet Pays | 3 | 2:1 |
| Winning a | Even or Odd | Bet Pays | 2 | 1:1 |
| Winning a | Red or Black | Bet Pays | 2 | 1:1 |
| Winning a | 1 to 8 or 19 to 36 | Bet Pays | 2 | 1:1 |

For example, if a player has wagered on the number 24 in a <<straight up>> bet and 24 is the winning number, then the player receives, in addition to his or her returned bet amount, 35 times his or her bet amount, for a total payout amount of 36 times his or her bet amount.

When a betting period ends, a dealer starts the random selection process. In live table roulette, the dealer typically launches a ball in the roulette in rotation. The random selection is performed when the ball positions itself in one of the notches arranged side-by-side on the internal side of the roulette rim, each notch being associated with a betting number. The dealer distributes the payouts to the players according to the payout table.

An important advantage of the roulette game is that the roulette game is based solely on a random event wherein wins and losses made by players or the casino house are independent of player skill. The players appreciate the simplicity of the game which triggers feelings of enjoyment and relaxation.

The casino house appreciates the fact that the income percentage is constant and not influenced by player experience and skill compared to other games such as Poker and Blackjack card games where the casino house's losses depend on player strategies and skills.

Another advantage of the Roulette is the various levels of betting risk offered: players appreciate to choose and control their own level of betting risk according to their gut feeling and their wealth. The casino house appreciates that conservative players as well as high-rollers may be at ease to participate in a casino game that favors an optimal table activity in terms of number of players and dedication to the game.

A random process independent of player skill and a variability of betting risk levels are two advantages that have contributed to make the Roulette a very popular and appreciated table game among players and casino management.

However, the Roulette numbers are less attractive to players than playing cards. The cards show colorful betting symbols in addition to numbers such as objects: <<spade>>, <<club>>, <<diamond>> and <<heart>> and noble characters: <<King>>, <<Queen>> and <<Jack>>; features to which players are inclined to attribute various lucky or unlucky properties. Players prefer playing games offering card betting symbols.

Furthermore, the income percentage cannot be changed for a roulette game without changing the game itself. For example, the casino income ratio for the European Roulette is 1/37, or approximately 2,70% and for the American Roulette is 2/38, or approximately 5,26%. Consequently, the casino house cannot adjust the income percentage according to market competition or the casino activity.

The possibility of modifying the casino income percentage without changing the roulette game would be a great advantage. For example, a casino could decrease the Roulette income percentage to create an incentive to players during low casino activity periods or to create some frenzied hours enjoyed by players. Also, a casino having regular customers and low or no competition such as local or governmental casinos, could appreciate and find advantageous for the casino house to increase its income percentage on crowded periods.

Therefore, a need exists for an enhanced roulette game that retains the advantages of classical roulette games, such as many betting risk levels on a same event, the socializing atmosphere, and the speed of the game, but overcomes classical roulette disadvantages by offering flexible casino incomes and more attractive features to players.

SUMMARY OF THE INVENTION

It has been found that to appeal and sustain the interest of players in new casino games, the games have to possess some elements familiar to the players, in order not to frighten them, and, at the same time, to offer new interesting features, in order to provide a new source of excitement and enjoyment for the player and interest for casinos.

The present invention provides a method and system for playing an enhanced roulette casino game by combining the advantages of classical European and American Roulette with new features that solve some disadvantages of classical roulette games.

More precisely, the present invention provides an enhanced roulette game based on a random event wherein player and casino wins or losses are independent of player skill and offers a variability of risk levels to players with new advantages such as attractive betting symbols and flexible casino house income percentages.

The present invention further provides a method and system for playing an enhanced casino game, which offers to players familiar, and well known appreciated Roulette betting options wherein odds may be different without it being apparent to players and without changing the style of the game.

The present invention also provides a method and system for playing a casino game that offers new and additional betting options.

According to one aspect of the present invention, there is provided a method of playing a casino table game comprising: identifying cards from a deck of playing cards as betting cards; recording a bet from a player identifying a number (n) of the betting cards; drawing at random from the deck of playing cards a payout-determining card; calculating a payout for the player of 48/n when the payout-determining card matches one of the betting cards identified, and otherwise a payout of zero when the payout-determining card does not match any of betting cards identified.

According to another aspect, a method of playing a casino card game comprising: identifying cards from a deck of playing cards as betting cards; identifying a remainder card from the deck of playing cards as outside card; recording a bet from a player identifying a number (n) of the betting cards; drawing at random from the deck of playing cards a payout-determining card; calculating a payout for the player of 48/n when the payout-determining card matches one of the betting cards identified, and otherwise a payout of zero when the payout-determining card does not match any betting cards identified.

A player has an opportunity to bet on the outcome of a random card selection from a deck of playing cards. A player selects a number of cards among cards identified as betting cards and bets on the occurrence of one of the number of cards will be randomly selected from the deck. The selected number of cards are identified by one or many following card features: rank, color, suit, parity, rank range or by a geometrical characteristic as column, block, circle etc. The player decides which level of betting risk he or she wants to take on the outcome of the random event in selecting a number of cards and in deciding his or her betting amount. A random card selection from a deck of playing cards is performed.

If there is a match between at least one card identified by the bet made by the player, his or her bet is a winning bet. A payout is credited to the player accordingly to a payout chart.

The method offers a new possible spectrum of payout odds as follows: 48 (47:1); 24 (23:1); 16 (15:1); 12 (11:1); 8 (7:1); 6 (5:1); 4 (3:1); 3 (2:1); 2 (1:1); compared to the payout odds of European or American roulette games: 36 (35:1); 18 (17:1); 12 (11:1); 9 (8:1); 6 (5:1); 4 (3:1); 2 (1:1).

The use of playing cards, adding new betting options and various colorful features, compared to betting options of classical roulette games, is attractive to players.

In one embodiment, a play board is provided with a game surface and betting locations. The game surface presents areas corresponding to cards of a playing deck and arranged in a geometric pattern. Geometrical characteristics formed by playing card areas of the game surface, such as: column, row, square, block, circle are used for identifying a number of playing cards. Each playing card area provides a betting location accepting a marker, token or chip and permitting players to make a wager on corresponding playing cards. The geometrical characteristic area accepts a marker and permits players to wager on a number of playing cards. A player makes a wager in placing markers, tokens or chips on an area identifying a card or a geometrical characteristic area. A random drawing from a deck of playing cards selects a payout-determining card. A principal game payout is calculated when the payout-determining card matches one betting card identified and, otherwise, a payout of zero is determined when the payout-determining card does not match any of betting cards identified. The player is credited with the payout.

According to one aspect of the invention, a system is provided comprising: an accepting means for accepting a bet identifying a number (n) of cards of a deck of playing cards; a random card selector for selecting at random at least one card of the deck; that is in comparing the identified number (n) cards to at least one the random selected card, the bet is a winning bet if there is a match between at least one card of the number (n) cards and one card of the randomly selected card.

For example, in one embodiment, a play board provides a game surface with 52 areas representing 52 playing cards. Forty-eight (48) playing card areas representing the forty-eight playing cards identified as betting cards are arranged in a rectangular configuration counting four (4) columns and twelve (12) rows. In the present embodiment, players enjoy familiar betting options similar to that of the Roulette, such as: <<straight up>>, <<split>>, <<street>>, <<column>>, <<block>> with new betting features such as: popular and colorful playing cards and a new spectrum of payout odds.

For example, in European or American roulette games, the spectrum of payout odds is: 36 (35:1); 18 (17:1); 12 (11:1); 9 (8:1); 6 (5:1); 4 (3:1); 2 (1:1). According to the present invention, the method offers for the same betting options and a new possible spectrum of payout odds as follows: 48 (47:1); 24 (23:1); 16 (15:1); 12 (11:1); 8 (7:1); 6 (5:1); 4 (3:1); 3 (2:1); 2(1:1).

If a player has wagered on two cards with a <<split>> betting option and one of the two cards is a winning card i.e. matches the randomly selected determining-payout card, then the player is credited 23 times his or her wagered amount in <<split>>mode, instead of 17 times like in the European or American roulette games, in addition to keeping his or her wagered amount for a total payout amount of 24 times his or her wagered amount.

The invention is appealing to players because of the familiar roulette betting options with a different spectrum of odds.

In addition, in one embodiment, the remaining cards, not identified as betting cards, are identified as <<outside>> cards.

Preferably, at least one of the <<outside cards>> is an <<all bets lose>> card, wherein all bets from the players are lost when the <<all bets lose >> card is drawn.

Preferably, at least one card of the outside cards is a <<free turn>> card, wherein the bets are returned to the players when <<free turn>> card is drawn.

A casino house determines the income percentage per game by modifying from turn to turn or setting the selection of <<all bets lose>> card and <<free turn>> card. The selections of zero, one, two, three or four cards as <<all bets lose>> cards, among a deck of 52 playing cards, wherein 48 cards as identified as betting cards, determines five different casino house income ratios.

For example, a casino takes a deck of playing cards having 52 playing cards, identifies 48 cards as betting cards and the four remaining cards as outside cards. The casino chooses one among the four <<outside>> cards as an <<all bets lose>> card and the three others are identified as <<free turn>> cards; providing a casino house income ratio of 1/49 or approximately of 2%. The casino selects, for another game two cards of the four outside cards as <<all bets lose>> cards and the remaining two of the outside cards as <<free turn>> cards, providing a casino house income ratio of 2/50 or approximately 4%.

Preferably, at least one of the betting cards is an <<all outside bets lose>> card wherein a payout is calculated for players that have made a bet on the <<all outside bets lose>> card, when the card is drawn. The payout amount can be calculated as a function of the total wagering amount made by the player on the game and/or the wagering amount solely made on the <<all outside bets lose>> card.

A betting option on an <<all outside bets lose>> card is attractive to players since it provides them with a feeling of control on the random event, giving players an additional manner for determining their betting risk on their total betting amount.

A betting option on an <<all outside bets lose>> card represents for a casino an interesting feature in potentially increasing casino house incomes by attracting players to wager large amounts because of the opportunity of securing their betting amounts.

Preferably, a player has the possibility to make a bet identifying a number s of betting cards as <<bet securing>> cards.

A <<bet securing>> card is a betting card on which a player can make a bet identifying the betting card as a <<bet securing>> card. The <<bet securing>> card identified as <<bet securing>> card by a bet made by the player on the betting card, allows the player to lower the original casino house income ratio for his or her bet identifying a number n of the betting cards. When the <<bet securing>> card identified by a bet made by a player matches the drawn payout-determining card, all bets made by the player identifying a number n of betting cards, excepted the bet identifying a <<bet securing>> card made by the same player on the game, are returned to the player giving the player the opportunity to take advantage of a lower casino house income ratio for his or her bet amounts identifying a number n of betting cards.

The possibility of identifying a <<bet securing>> card allows players to get a lower casino house income ratio for bets identifying a number n of betting cards above a particular betting amount, i.e. a turning-point total betting amount, and gives the casino an interesting feature to potentially increase casino house income which is also applicable to classical roulette games.

A <<bet securing>> option is an incentive allowing players to take advantage of a lower casino house income ratio for their total betting amounts, and particularly, it is an incentive for high-rollers to bet larger amounts. For high-rollers, a <<bet securing>> option wager represents a small additional amount compared to typical high-roller wagered amounts. The casino house retains a minimal income ratio until the turning-point betting amount is reached and at the same time, favors betting larger amounts. Consequently, the casino house income is potentially increased for each game of the present method of playing an enhanced casino roulette game which represents a real advantage for casino owners.

BRIEF DESCRIPTION OF THE DRAWINGS

These and other features, aspects and advantages of the present invention will become better understood with regard to the following description and accompanying drawings wherein.

DETAILED DESCRIPTION OF THE PREFERRED EMBODIMENTS

Figure 1A:
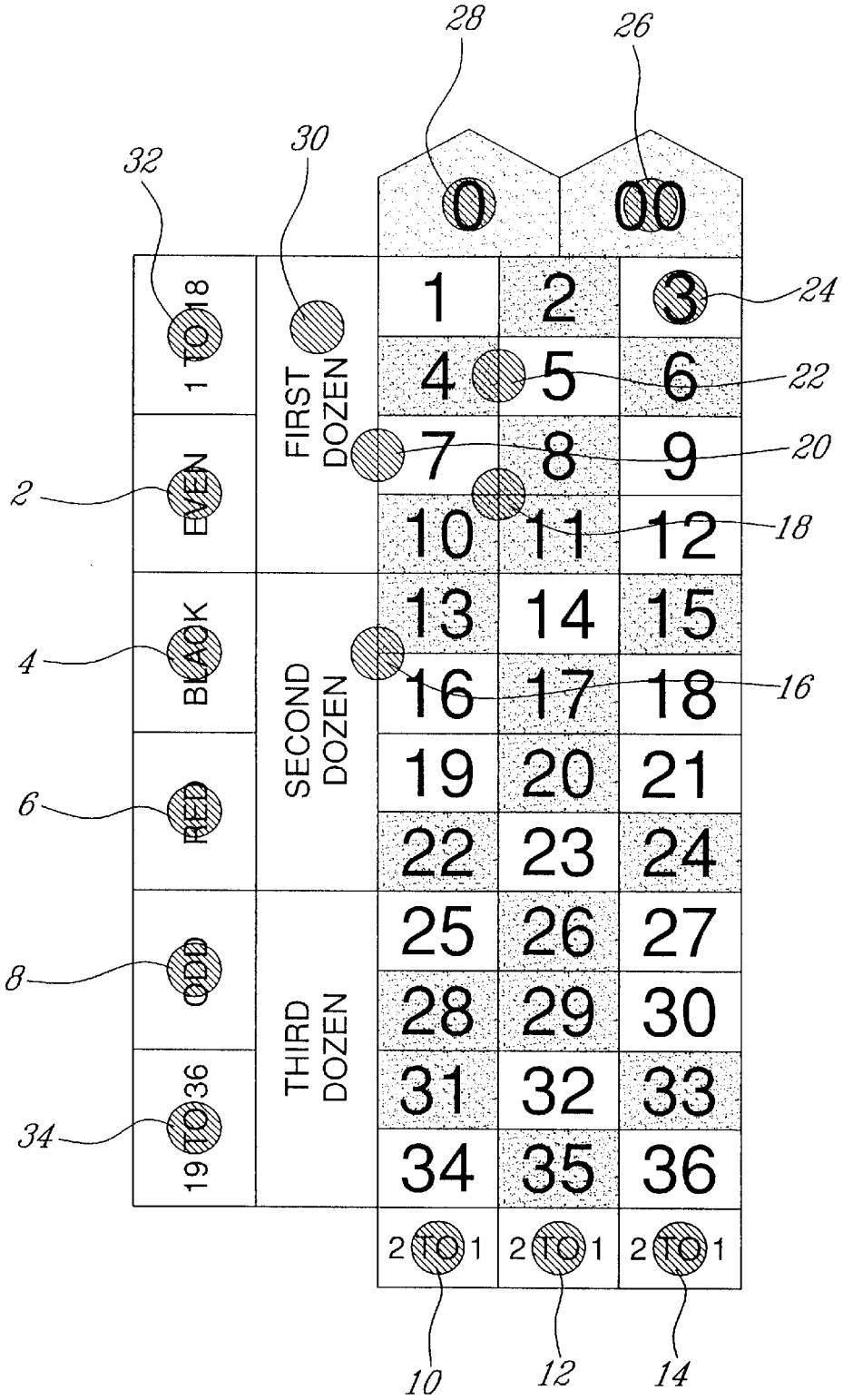
FIG. 1A (PRIOR ART)
FIG. 1A is a schematic representation of a prior art classical American roulette game surface and FIG. 1B is an auxiliary game surface layout.
Figure 1B:
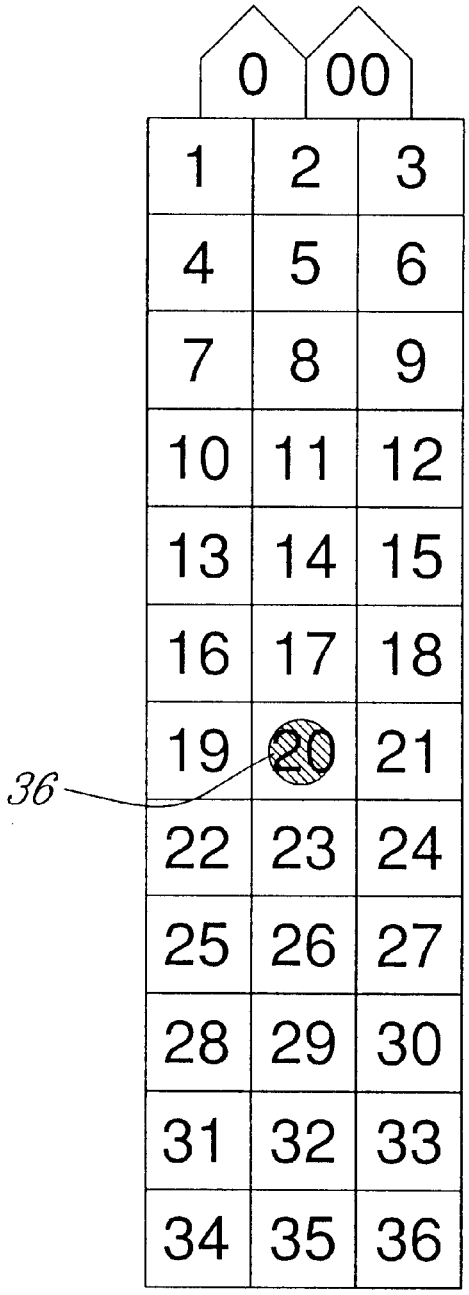
FIG. 1B (PRIOR ART)

Referring to FIG. 1A, which is a representation of the betting layout of a classical American roulette game and FIG. 1B which is an auxiliary betting layout, the thirty-six (36) squares are shown, each one being associated to a number 1 to 36, laid out in twelve (12) stacked rows, of three (3) adjacent squares each. There are also two special areas, representing a zero <<0>> 28 and a double zero <<00>> 26 which represent betting squares for <<all outside bets lose>> events. Note that in the European roulette game, the layout is the same except that there is no double zero <<00>> area.

A player chooses his or her betting risk level by positioning markers, chips or tokens on areas corresponding to the betting options typically offered by classical roulette games. Examples of such bets are illustrated in FIG. 1A, wherein the dark circles are tokens shown are the <<straight up>> 24, <<splits>> 22, <<line>> 20, <<square>> 18, <<street>> 16, <<dozen>> 30, <<column>> 10, 12 or 14, <<odd>> or <<even>>, 2 or 8, <<black>> or <<red>> 4 or 6, and <<lows>> or <<highs>> 32 or 34.

FIG. 1B, is an auxiliary roulette layout. Some auxiliary roulette games associated with a principal roulette game offer players the opportunity to make an additional or a side bet by selecting one of the conventional numbers of the roulette game, i.e. 1–36, 0 or 00 without regards to parity or color. Shown are the thirty-six (36) squares laid out in twelve (12) stacked rows, each row of three (3) adjacent squares, each one associated with a particular number from 1 to 36 and two additional squares labeled <<0>> and <<00>>. A player indicates his or her additional or side bet option by placing markers, chips or tokens on one of the conventional numbers i.e. 1 to 36, 0 and 00 of the roulette auxiliary game surface layout. As an example, a wager 36 has been put on number 20.

Figure 2:
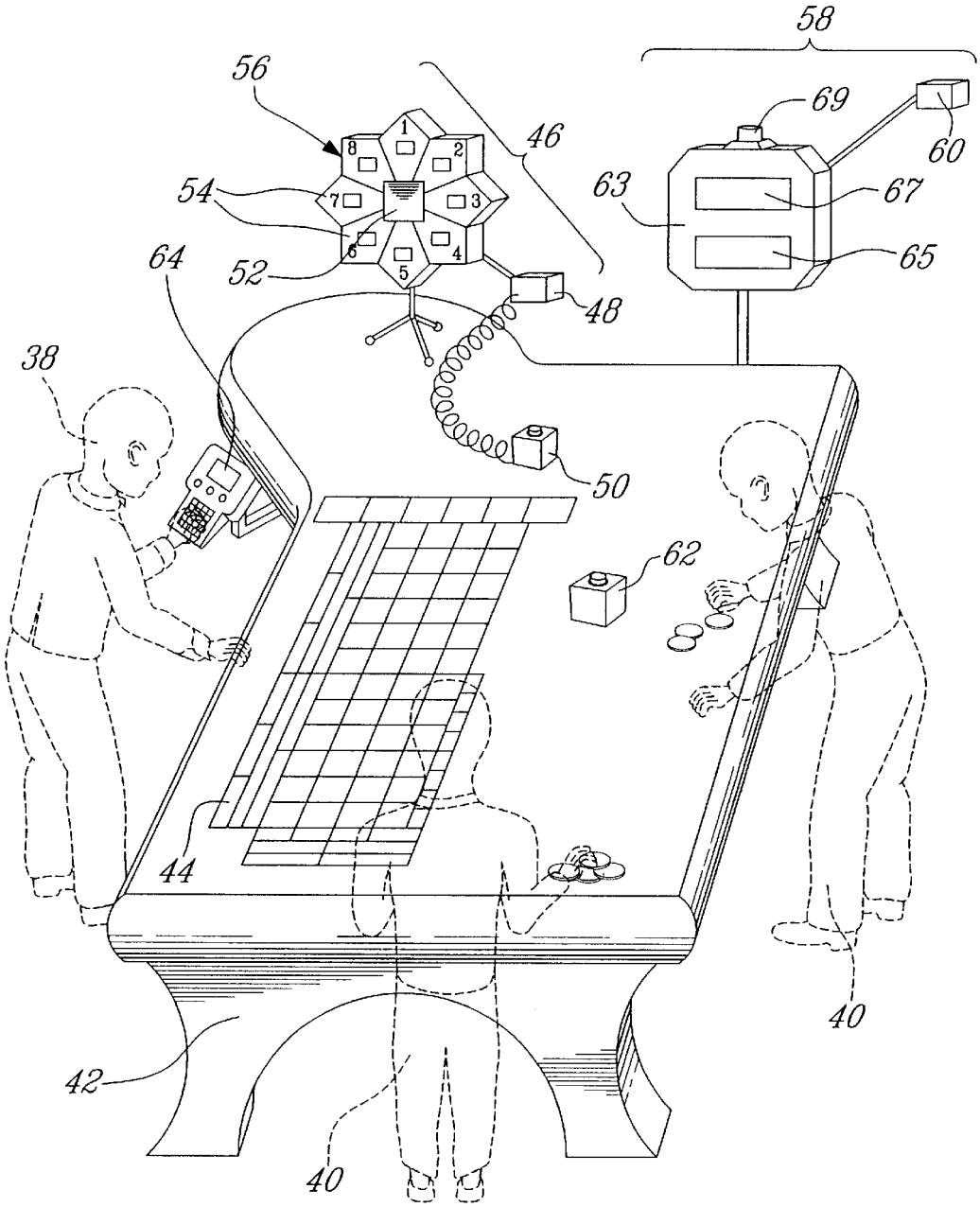
FIG. 2 is a schematic view and representation of the system of the present invention.

How to play the present enhanced roulette game and use the system may be understood by referring to FIG. 2 of the drawings, which shows a live table casino game played by a dealer 38 and a plurality of players 40 surrounding a casino table 42. The betting game surface layout 44 is placed in an efficient and aesthetic manner allowing a dealer and players to properly accomplish their movements in an easy and efficient manner. A random selector 46 randomly selects a card and a player position. In the present embodiment, the random card and player position selector 46 is an electronic apparatus, known in the art, comprising a random selector controller 48, which manages electronic commands. A random card and player position selector control 50 connected to the random card and player position selector controller 48 is provided with a button, or a switch, which activates a random card and player position selection and a displaying of the selected card on the screen 52 and the selected player position on the selected screen among screens 54 of the display 56.

A random prize selector 58 is also provided with the present invention and can be used, optionally, with some auxiliary games. In the present embodiment, the random prize selector 58 is an electronic apparatus known in the art, comprising a random prize selector controller 60, which manages various electric signals.

A random prize selector control 62, in communication with the random prize selector controller 60, is provided with a button or switch that activates a random prize selection and a displaying of the prize on the display 63. The display 63 provides two screens 65, 67 for displaying data and various visual animations such as prize amounts, and other winning symbols, such as a happy face. Furthermore, visual communication means, such as a light 69, are provided for accompanying and indicating the various steps such as the prize generation process, the prize selection process and the prize granting and communicating processes.

Furthermore, a dealer console 64 connected to the random card and player position selection controller 48 and to the random prize selection controller 60 is provided with the present invention in order to input commands required before the selection processes, such as the activation of the random card and player position selector control 50 and the random prize selector control 60.

It will be easily understood that the random selector and the display apparatus can be integrated, or not, in the same apparatus.

It will also be understood that each random selector, such as the random card selector, the random player position selector, and the random prize selector, can be considered as individual and separate apparatuses that can be integrated, or not, in one or more apparatuses.

It will also be understood that the random card selector, can take many embodiments. For example, it can be a mechanical apparatus such as a roulette wheel with 52 notches, wherein inside each notch is shown a card among the 52 playing cards of a deck; an electromechanical card shuffler capable of picking up a card randomly, or any other analogous apparatus can also be used. In the present embodiment, the random generator is an electronic apparatus known in the art. In the preferred embodiment, the random card selector is an electronic random generator due to the reliability and speed needed for the occurring random event.

In addition to the random card selector, the present invention also provides a random player selector. Again, the player position selector apparatus can take various embodiments, such as a dice-prism with eight faces, each face representing a particular player position with a number between 1 and 8 or one of the 8 chip colors: a ball associated with a wheel of a minimum of eight pockets or notches, each one representing a number from 1 to 8 and/or a chip color. In the present embodiment, the random player selector is an electronic random selector. The reason is the reliability and the speed necessary for the random process. In the present embodiment, there is a maximum of 8 players at each table.

It will be furthermore understood that various combinations of switches and buttons are possible for reaching the same objective. The number and the activation sequence of the buttons or switches and their association to the dealer and/or the random selector control depend on various considerations, such as the speed of the game, and the interest of the player. For example, for each random selection of a card or a player position, a particular button or switch can be provided for each of the following steps: a first switch or button for starting a random generation process; a second switch or button for stopping the random generation process, and executing a random selection; a third switch or button for displaying the selected item on the screen, and another switch or button for resetting the random selector and display.

As it is understood, all these functions can be integrated in one or more operations, started by one or more switches.

Figure 3:
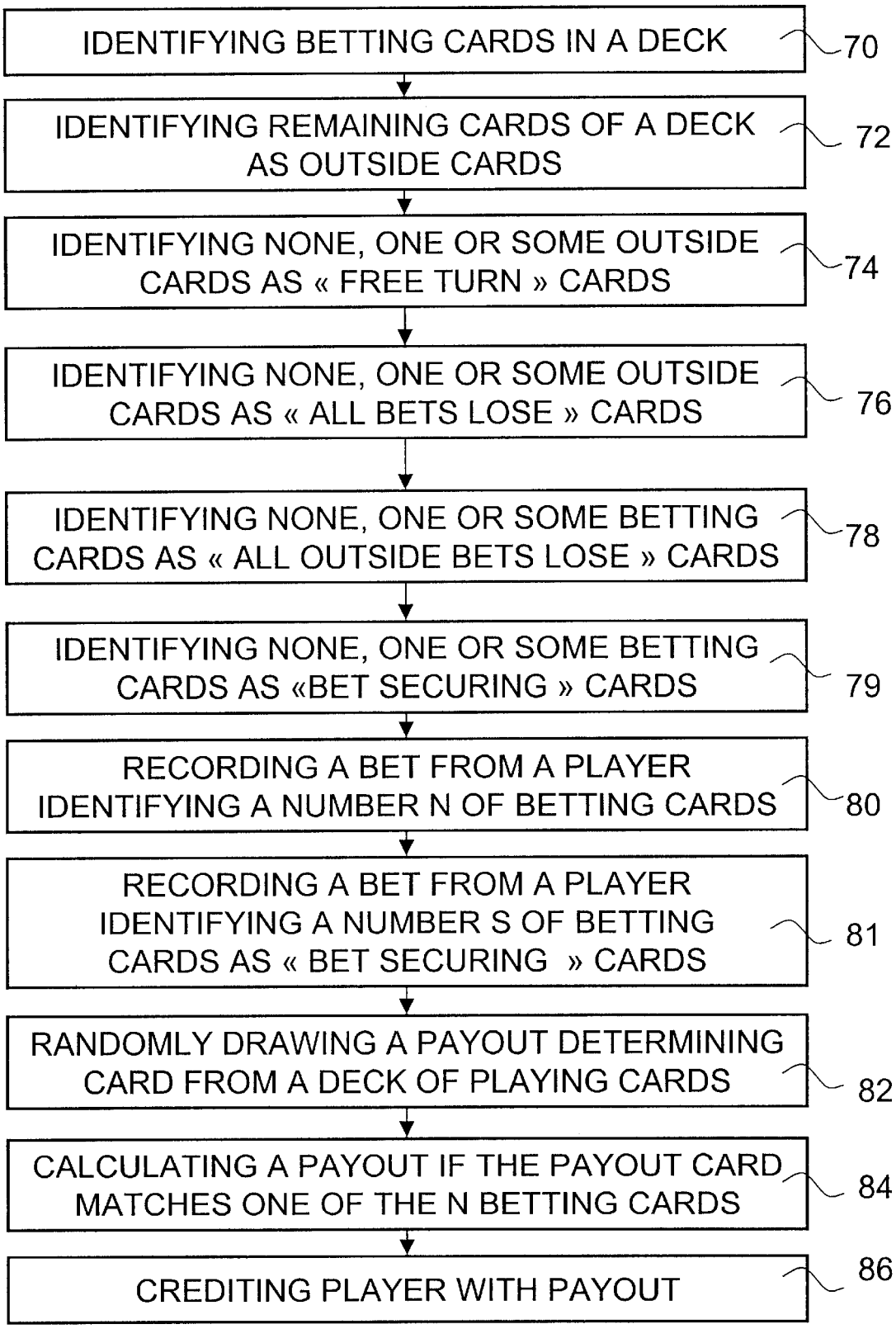
FIG. 3 is a flow chart representing the method of a preferred embodiment of the present invention.

Referring now to FIG. 3, shown is a flow chart representing a preferred embodiment of the method of the present invention. The term <<betting>> card refers to a designated card that can be drawn randomly from a deck of playing cards and on which a player can make a wager on the occurrence of the <<betting>> card as a randomly drawn payout-determining card from the deck of playing cards.

The method comprises a step of Identifying cards from a deck of playing cards as betting cards 70. Preferably 48 cards are identified as betting cards.

The playing cards possess various betting symbols such as numbers and colors allowing Roulette betting options such as <<highs>> or <<lows>>, <<even>> or <<odd>>, <<black>> or <<red>> to be offered to players.

In addition to numbers, various and different betting symbols such as <<faces>> (<<King>>, <<Queen>>, <<Jack>>) and <<objects>> (<<spade>>, <<heart>>, <<diamond>> and <<club>>). The playing card features are more attractive to players because, in card games, players intensely manipulate playing cards and are more inclined to associate lucky properties to playing card symbols.

Playing card decks usually have 52 or 54 cards comprising 13 cards as follows: Ace, 1, 2, 3, 4, 5, 6, 7, 8, 9, 10, Jack, Queen and King for each of the four suits, usually <<heart>>, <<club>>, <<spade>> and <<diamond>> and, for the 54 playing card decks, two Jokers are added. The use of a well known complete deck of playing cards is attractive and makes players at ease with using familiar symbols.

In a preferred embodiment of the present invention, the deck has 52 cards. But, a skilled person in the field will appreciate the key features of the present method described, will understand, and will be able to apply the present method to a deck of cards having a lesser or a greater number of cards.

In the preferred embodiment, the choice of a bet identifying a number of betting cards among at least a minimal number of 48 betting cards provides a set of various risk levels depending of the number (n) of cards, such as: 24, 16, 12, 8, 6, 4, 3, 2, 1 allowing one to calculate a payout of 48/n wherein the payout amount is an integer. For example, a player selects one card with a <<straight up>> bet among the 48 betting cards and another player wagers on two numbers at the same time with a <<split>> bet. A payout of 48/1 (47:1) is calculated for the player who has identified a card with his or her <<straight up>> bet if the <<straight up>> wagered card matches the randomly drawn determining-payout card and a payout of 48/2=24 (23:1) is calculated for a player when one of the two cards identified by his or her <<split>> bet matches the randomly selected card. An integer payout amount is calculated.

The method of the present invention virtually provides 47 levels of betting risk i.e. 1 to 47 betting cards identified by a single bet. For example, if 13 betting cards have been identified in a single bet and the randomly selected payout-determining card matches one card among those 13 identified betting cards, the payout multiplication factor will be 48/13 or approximately 3.6923, a non-integer for which a payout amount is more difficult, long and complex to calculate for an individual. Of course, if an electronic apparatus is used to calculate the corresponding payout amount, it is easier, faster and more accurate. If the present enhanced roulette game is played on an electronic apparatus or device, such as a video game or slot machine, non-integer payout multiplication factors do not necessarily create a problem and may still provides advantages to players and casinos.

However, on a live table game, non-integer layout multiplication factors are unsuitable. The time for calculating a layout by the dealer, even if he or she has an electronic calculator, would most likely be unacceptable and would result in more mistakes. The player could have more difficulties to choose his or her betting risk and would take more time to wager in reason of large number of various betting risks.

Furthermore, betting risks offered in such a large number of choices could require additional features and/or conventions to record a bet from a player identifying a number between 1 and 47 among betting cards and could overload processes or rules of the game. In a context of live casino table game, a large set of betting risk levels, i.e. a number of 1 to 47 betting cards identified by a single bet from a player, could put a disadvantage to rapidity and simplicity of the present enhanced roulette game in a live casino environment.

The payout table preferably provides various payouts that represent various integer multiplication factors that allows to calculate the payout rapidly and easily by players and dealers. A restricted number of payout integer multiplication factors such as 48 (1:47), 24 (1:23), 16 (1:15); 12 (1:11), 8 (1:7), 6 (1:5), 4 (1:3) 3 (1:2), 2 (1:1) from which a payout amount to players is easily calculated by a dealer, provides rapidity for the game and accuracy for credit transactions which favor enhanced Roulette table profitability.

For a conventional roulette game, 8 levels of betting risk on the random selection of number from 1 to 36 is provided, such as 36 (1:35); 18 (1:17); 12 (1:11); 9 (1:8); 6 (1:5); 4 (1:3); 3 (1:2); 2 (1:1), corresponding to various integer dividing factors of the number 36. According to the preferred embodiment of the present invention, the spectrum of betting risk has 9 different betting risk levels, such as: 48 (1:47); 24 (1:23); 16 (1:15); 12 (1:11); 8 (1:7);6 (1:5); 4 (1:3); 3 (1:2); 2 (1:1), corresponding to various integer dividing factors of the number 48.

According to the present invention, offering a larger spectrum of risk levels attracts the players because of the larger flexibility and control in the determination of the betting risk on the random event. Furthermore, offering different betting risks compared with the betting risks offered in classical roulette games, provides an appeal to players in the game of the present invention because it renews the betting strategies of the roulette game.

Referring back to FIG. 3, the method comprises the step of identifying remainder cards from the deck of playing cards as outside cards 72.

The choice of cards as outside cards, allows to use the totality of cards of the playing deck, and at the same time, to obtain a suitable minimum multifactorial number such as 48 for the number of betting cards. The number of remainder cards depends on the number of cards of the playing deck used.

As previously noted, the number of remainder cards can be considerable if a convenient number of extra cards are added to a deck of 52 playing cards.

The number of outside cards can vary depending of the number of cards of the playing deck; the objective being to obtain at least a number of 48 betting cards. In the present preferred embodiment, the number of outside cards is 4 or 6 depending of the number of cards available in the deck of playing cards: 52 or 54 cards (with two jokers).

When a bet from a player identifies all of the betting cards in a same suit, it would be preferable that a number (n) of the betting cards are identified such that the payout multiplication factor calculated be an integer amount. In a preferred embodiment, a card from each suit is selected as an outside card such that when a bet from a player identifies all betting cards in a same suit, a number n=12 of the betting cards is identified and a payout is calculated such that 48/n is an integer.

Preferably, the outside cards are four cards of odd face value so that when a bet from a player identifies all of the betting cards of a same parity <<odd>> or <<even>>, a number of 24 of the betting cards are identified and a payout can be calculated such as 48/n is an integer.

Preferably, the outside cards are four cards of a same face value 7 so that when a bet from a player identifies all of the betting cards in a same range of face values, in one of the two ranges of face value lower or higher than face value 7, a number of n=24 of the betting cards, all of the betting cards in a same range of values is identified and a payout is calculated such as 48/n is an integer.

Therefore, the card which is preferably removed from each suit of a standard deck of cards is preferably the card with a face value of 7.

The classical European and American roulette games are commonly characterized by the same spectrum of betting options with the corresponding payout chart table shown in table 2.

TABLE 2

Spectrum of betting options and payout table.

| Betting Options | Payout For Winning Bets: Amount Received By Player | Payout For Winning Bets: Probability |
|---|---|---|
| <<Straight up>> | 36 | (35:1) |
| <<Split>> | 18 | (17:1) |
| <<Line>> | 12 | (11:1) |
| <<Square>> | 9 | (8:1) |
| <<Street>> | 6 | (5:1) |
| <<12 number Column>> | 3 | (2:1) |
| <<12 number block>> | 3 | (2:1) |
| <<Odd>> or <<Even>> | 2 | (1:1) |
| <<Lows>> or <<Highs>> | 2 | (1:1) |
| <<Red>> or <<Black>> | 2 | (1:1) |

Numbers without parentheses represent total amounts received by the player. The amount corresponds to 36/n and comprises the bet amount refund to the player plus the bet amount from the player times the winning odds of the bet expressed in parentheses. For example, for a winning <<straight up>> bet, a payout of 36/1=36 is calculated. Consequently, the player receives an amount that equals the payout multiplication factor, i.e. 36, times his or her betting amount. The amount corresponds to the sum of the bet amount refund to the player and the calculated payout-winning amount. For the present example, the total amount paid to the player is the bet amount wagered by the player plus 35 (35:1) times the player bet amount for a total amount received by the player for his or her winning <<straight up>> bet of 36 times his or her wagered amount.

The European or American Roulette games offer players the same type of betting options with the same payout chart table, with the same rules and betting options.

The difference between the European Roulette casino house income ratio of 1/37 or approximately 2.71% and the American Roulette casino house income ratio of 2/38 or approximately 5.26% comes essentially from the number of <<all outside bets lose>> betting numbers. There is a single betting number <<0>> for the European Roulette game and two <<all side bets lose>> numbers, <<0>> and <<00>> for the American Roulette game.

Therefore, by modifying only the number of <<all outside bets lose>> numbers, the present invention maintains the essential features of the Roulette game. The Roulette game is characterized by offering a plurality of betting risks to players and a coherent layout chart table in the sense that the difference between two betting risk levels is respected in the payout chart table.

For example, if a betting option has two times less chances than an other type of betting option to be a winning bet, for example comparing a <<split>> bet with a <<straight up>> bet, the difference between betting risk levels is respected and reflected in the payout chart table so that a payout for a <<split>> winning bet is 18 (17:1) compared to 36 (35:1) for a <<straight up>> winning bet.

As it can be appreciated, for the Roulette game, the casino house income percentage can be changed by decreasing or increasing the number of <<all outside bets lose>> betting options.

Unfortunately, modifying the casino house income ratio for one or another of the classical European and American roulette games by varying the number of <<all outside bets lose>> betting options is difficult to put in practice.

An important constraint is that a modification to the casino house income percentage by modifying the number of <<all outside bets lose>> options implies adding an <<all outside bets lose>> betting symbol, an uncommon betting symbol, therefore breaking the comforting and familiar suit of classical Roulette betting symbols.

The deletion of an <<all outside bets lose>> betting symbol is not considered because deleting an <<all outside bets lose>> option in the American Roulette game corresponds to making a European Roulette game. Deleting an <<all outside bets lose>> option in an European roulette game defines a casino house income ratio of zero for <<outside bet>> options such as: <<red>> or <<black>>, <<high>> or <<low>>, <<odd>> or <<even>>. Consequently, it provides an incoherent payout chart table.

Adding an <<all outside bets lose>> betting symbol defines a real lower income ratio for players. Consequently, adding an <<all outside bets lose>> betting symbol has the non-negligible risk to be more repulsive than attractive to players, a result unsuitable for casino management and the gaming industry.

Another important constraint is that each time an <<all outside bets lose>> betting option is added, the roulette wheel apparatus and the game surface have to be changed. The physical re-design and modifications to the apparatus and surface represent important costs and are incompatible with a rapid, flexible and cheap method to promptly and easily adjust the casino house income ratio in response to periods of various intensities of casino roulette game activity.

In the preferred embodiment, for a 52 playing card deck, the four chosen cards as <<outside>> or <<all outside bets lose>> cards are the four 7's, and for a 54 playing card deck, the six cards chosen, as outside or <<all outside bets lose>> cards are the four 7's and the two jokers.

The choice of the 7's, and Jokers from a deck of 54 playing cards, as <<outside>> or <<all outside bets lose>> cards permits to split the remaining 48 betting cards into two groups of equal number of betting cards; a low (i.e. Ace to 6) and an high (8 to King) card rank categories. Furthermore, the seven's and jokers typically represent <<special cards>> associated with some lucky or special properties in a casino game.

Referring back to FIG. 3, the method comprises the step of identifying none, one or some of the outside cards as <<free turn>> cards 74.

An outside card identified as a <<free turn>> card means that when the card identified as a <<free turn>> card is randomly drawn from a deck of playing cards as the payout-determining card, all bets are returned to players.

The method further comprises the step of identifying none, one or some of outside cards as <<all bets lose>> cards 76.

An outside card identified as an <<all bets lose>> card means that when an <<outside>> card identified as an <<all bets lose>> card is randomly drawn from a deck of playing cards, as the payout-determining card, all bets by all players are lost and are taken by the casino house.

Preferably, at least one card of the outside cards is identified as an <<all bets lose>> card, wherein a payout of zero is calculated when the <<all bets lose>> card is randomly drawn.

In identifying the <<free turn>> and <<all bets lose>> cards among the outside cards, the casino determines its desired casino house income ratio.

For example, with a deck of 54 playing cards, from 0 to 6 cards can be identified as <<all bets lose>> cards among the six cards identified as <<outside>> cards and the remainder cards can be identified as <<free turn>> cards. This will determine seven casino house ratios for an enhanced roulette casino game that uses a deck of 54 playing cards and gives a payout for a winning <<straight up>> bet of 48 (47:1). Table 3 illustrates the seven casino house ratios available.

TABLE 3

Seven Casino House Ratios

| Number of Cards Identified as <<all bets lose>> Card | Number of Cards Identified as <<free turn>> Card | Casino Income Ratio |
|---|---|---|
| 0 | 6 | 11.11% (6/54) |
| 1 | 5 | 9.43% (5/53) |
| 2 | 4 | 7.69% (4/52) |
| 3 | 3 | 5.88% (3/51) |
| 4 | 2 | 4.00% (2/50) |
| 5 | 1 | 2.04% (1/49) |
| 6 | 0 | 0.00% (0/48) |

It can be appreciated that switching between the seven casino income ratios is done by changing the number of cards identified as <<all bets lose>> cards and <<free turn>> cards among the 6 cards identified as <<outside>> cards.

The method further comprises the step of identifying none, one or some of the outside cards as <<all outside bets lose>> cards 78.

An outside card identified as an <<all outside bets lose>> card, is in fact an outside card changed into a special betting card, and an <<all outside bets lose>> card means that when the outside card identified as <<all outside bets lose>> card is randomly drawn from a deck of playing cards, all bets made by the players are lost except the wager made by a player identifying uniquely the <<all outside bets lose>> card drawn. A payout amount is made to the player that has made a bet identifying uniquely a drawn <<all outside bets lose>> card when the <<all outside bets lose>> card is randomly drawn from a playing deck as the payout-determining card. The payout amount can be as a function of the wager amount made by the player identifying solely the <<all outside bets lose>> card, or in function of the total amount wager on the game made by the player.

Preferably, at least one card of the <<outside>> cards is an <<all outside bets lose>> card wherein a payout is calculated for a player that has made a bet on a card, when the <<all outside bets lose>> card is randomly drawn and corresponds to a payout-determining card.

A betting option on an <<all outside bets lose>> card has some advantages.

If a payout amount calculated is the same as that of a winning <<straight up>> bet, for example 48 (47:1) in the preferred embodiment of the live casino table, then the <<all outside bets lose>> cards permit to increase casino income ratio in the same proportion as that of the outside card identified as <<all bets lose>> card but provide an added betting option for players and consequently, a potentially increased casino house income for roulette games.

For example, during a normal game of the enhanced roulette game, it is decided that, for the next game, an <<outside>> card identified as an <<all bets lose>> card will be an <<all outside bets lose>> card that has the same payout as a winning <<straight up>> bet, for example 48 (47:1).

An <<all outside bets lose>> card is appealing to players because it gives an additional betting option to establish their betting risk levels and gives the players an opportunity to secure their betting amount.

An <<all outside bets lose>> card is appealing to casino houses, since it ensures the same casino house income but potentially increases incomes by offering an additional betting option.

The method further comprises the step of identifying none, one, or some of betting cards as <<bet securing>> cards 79.

Preferably, a player has the possibility to make a bet in which a number s of the betting cards are identified as <<bet securing>> cards.

A <<bet securing>> card is a betting card on which a player can make a bet identifying the betting card as a <<bet securing>> card. The <<bet securing>> card identified as a <<bet securing>> card by a bet made by the player on the card, allows the player to lower the original casino house income ratio for his or her bet by identifying a number n of betting cards. When the <<bet securing>> card identified by a bet made by a player matches the drawn payout-determining card, all bets made by the player identifying a number n of betting cards, except the bet identifying a <<bet securing>> card made by the player on the game, are refunded to the player, thus providing to the player the opportunity to take advantage of selecting a lower casino house income ratio for his or her bets.

Figure 4:
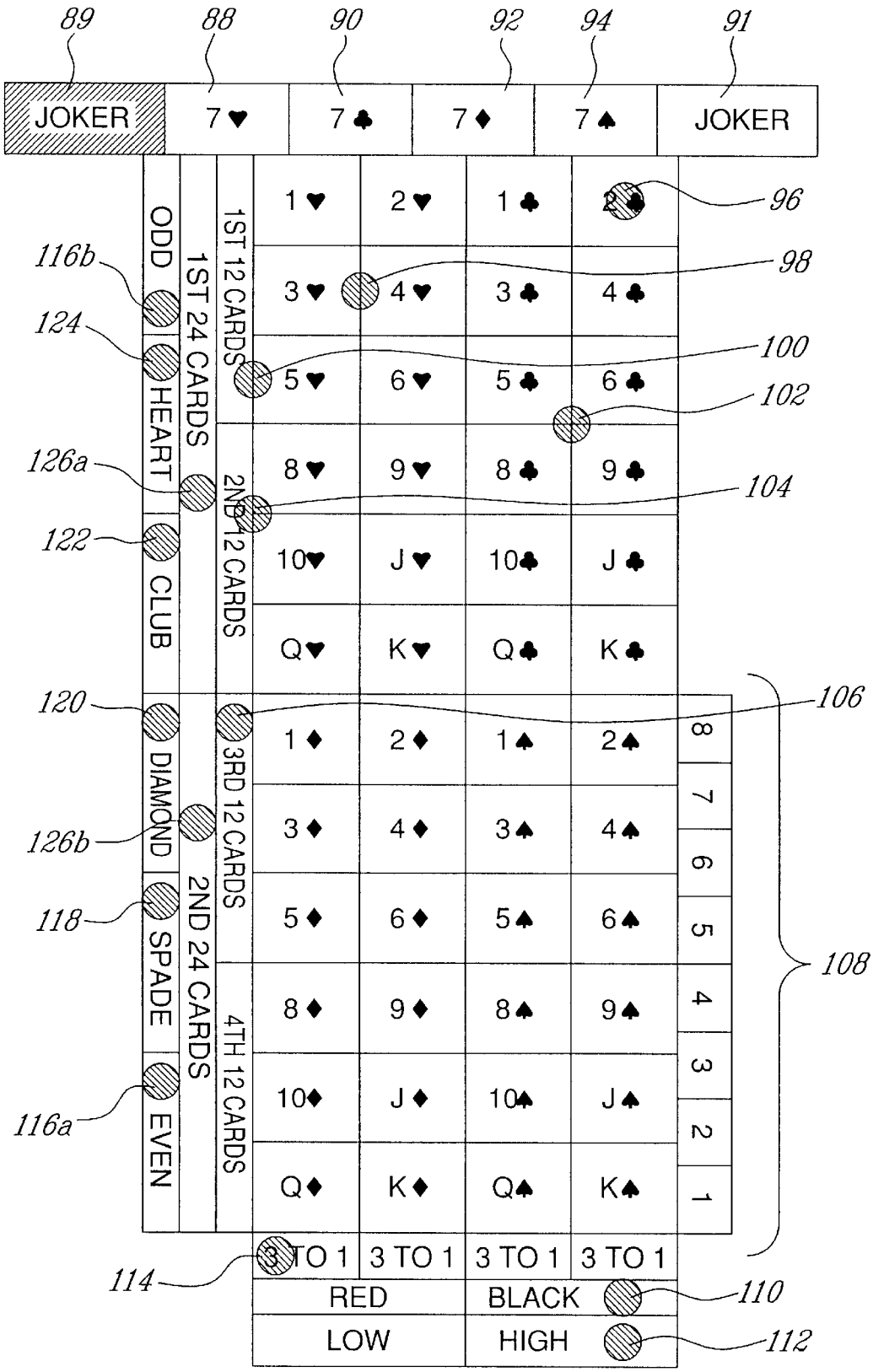
FIG. 4 is a schematic representation of the game surface of the present invention.

For example, a game surface having 54 areas corresponding to 54 playing cards and arranged in a geometric pattern is shown in FIG. 4. The two jokers are identified as <<free turn >> cards. Two of the four sevens cards are identified as <<all outside bets lose>> cards, one of the four seven cards is identified as an <<all bets lose>> card and the last one of the four seven cards is identified as a <<free turn>> card. The payout for a winning <<straight up>> bet is 48 (47:1). The casino house income ratio is 3/51 or approximately 5,66%.

Also, in the present example, the casino house offers to players an opportunity to identify one of the two <<all outside bets lose>> cards as a <<bet securing>> card by a wager made by the player on one of the two <<all outside bets lose>> cards.

A practical example is as follows: a player makes a bet identifying an <<all outside bets lose>> card as a <<bet securing>> card by positioning a marker of a minimal bet amount, for example $1.00. Identifying a betting card as a <<bet securing>> card is equivalent for the player of paying an amount of $1.00 for playing the game with a lower casino house income ratio of 2/50 or approximately of 4.00% for his or her other bets. The normal casino house income ratio would be 3/51 or approximately of 5.66%. A bet amount identifying a number of n betting cards with a bet identifying a number s of betting cards as a <<bet securing>> card is profitable to a player when the amount is larger then a turning-point total betting amount N determined by solving the following equations:

$$M\times(1-IR^*)\geqq N\times(1-IR)$$

$$M+S=N$$

Wherein,

S is the minimal bet amount required to identify a betting card as a <<bet securing>> card.

IR is the statistical casino income ratio on a bet identifying a number n of betting cards before identification of a betting card as a <<bet securing>> card;

IR* is the statistical casino income ratio on a bet identifying a number n of betting cards after identification of a betting card as a <<bet securing>> card;

N is the turning-point total betting amount comprising the bet amount identifying a number n of betting cards (M) and the minimal bet amount required to identify a betting card as a <<bet securing>> card (S);

M is the bet amount identifying a number n of betting cards with IR*;

(1−IR) and (1−IR*) are corresponding statistical player refund ratios.

In the current example, the winning bet <<straight up>> pays 48 (47:1). If a player bets a total amount of $51.00 without identifying a <<bet securing>> card, then the player refund ratio is 48/51 and the statistical player refund bet amount is $48.00. If a player with the same total amount of $51.00, identifies a <<bet securing>> card by giving to the casino house $1.00 for taking advantage of a lower casino house income ratio of 48/50 and bets an amount of $50.00 identifying a number of n betting cards, the statistical refund amount for the player is also $48.00.

If a player bets a betting amount of $52.00, it will be more favorable for him or her to identify a <<bet securing>> card with $1.00 and bet an amount of $51.00 identifying a number of n betting cards with a statistical player refund ratio of 48/50 and statistical player refund amount of $48.96 than to bet a total amount of $52.00 identifying a number of n betting cards with a statistical player refund ratio of 48/51 with a statistical player refund amount of $48.94.

On the contrary, if a player bets a betting amount of $50.00, it will be more favorable to him or her to bet a total amount of $50.00 for identifying a number n of betting cards with a statistical player refund ratio of 48/51 and a statistical player refund amount of $47.06 rather than identifying a <<bet securing>> card with $1.00 to get a statistical player refund ratio of 48/52 and bet an amount of $49.00 identifying a number n of betting cards with a statistical player refund amount of approximately of $47.04. The total betting amount of $51.00 is the turning-point total betting amount for deciding to identify or not a <<bet securing>> card for $1.00 to pass from a casino house income ratio of 48/51 to a casino house income ratio of 48/50 wherein a winning <<straight up>> bet pays 48 (47:1) i.e. gives to the player that has made a winning <<straight up>> bet, an amount of 47 times his or her bet amount in addition of returning the bet amount to the player.

Consequently, the player who has made a bet identifying a betting card as a <<bet securing>> card and has wagered a total bet amount identifying a number n and s of betting cards larger than the turning-point total betting amount, is in the same situation as the player who makes a bet identifying a number n of the betting cards without any card identified as <<bet securing>> card in a game where there is a lower casino house income ratio. On the contrary, a player who has made a bet identifying a betting cards as a <<bet securing>> card and has wagered a total bet amount identifying a number of betting cards lower than the turning-point total betting amount, corresponds to a situation where the player plays in a higher casino house income game without identifying a card as a <<bet securing>> card.

A <<bet securing>> option is an incentive to players to take advantage of a lower casino house income ratio for their total betting amounts, and it is particularly attractive for high-rollers who bet larger amounts. For high rollers, a <<bet securing>> option wagered represents a small additional amount compared to typical high-roller wagered amounts. The casino house conserves a minimum income ratio until the turning-point total betting amount is reached and at the same time, favors betting amounts larger than the usual amounts bet by players and particularly, from high-rollers to bet larger amount than the turning-point total betting amount for taking advantage of more favorable casino income ratio for their total betting amount. Consequently, the casino house income is potentially increased for each game of the present method of playing an enhanced casino roulette game which represents a real advantage for casinos.

A Roulette game wherein <<free turn>> cards are randomly drawn could be considered equivalent to the absence of the game and may be viewed as a waste of time for a roulette game. But, in the present invention, a <<free turn>> card can be associated to extra or auxiliary betting options offered by the present enhanced Roulette. An additional bet permitting to wager on a <<free turn>> card, represents additional betting options and an opportunity to optimize the Roulette income.

Referring back to FIG. 3, the method further comprises the step of recording a bet from a player identifying a number n of betting cards 80.

In preferred embodiments, players position markers, chips or tokens on corresponding betting areas on a playing game surface. It is understood that electronic betting devices or apparatus can replace physical markers and game surfaces, and allow players to choose and record bets.

The method further comprises the step of recording a bet from a player identifying a number s of betting cards as <<bet securing>> cards 81.

In preferred embodiments, the markers and the manner used to identify a betting card as a <<bet securing>> card explicitly indicates which player has identified a betting card as <<bet securing>> card and which card has been identified as a <<bet securing>> card. For example, special markers identify each player by their colors.

The method comprises the step of drawing at random from a deck of playing cards a payout-determining card 82.

The random card selection can be started by a player or the dealer, manually with one or more decks of playing cards counting 52 or 54 cards, mechanically with a mechanical apparatus such as a roulette wheel where each notch represents a card of the deck, in an electromechanical manner with an electromechanical apparatus such as a card shuffler or electronically with an electronic apparatus such as an electronic random card selector.

In preferred embodiments, the random selection of a payout-determining card is performed by a random card selector because of the rapidity, low cost and fairness of the card selection process provided by an electronic apparatus compared with a physical roulette wheel. But, in some circumstances, a mechanical roulette wheel is more appropriate as a random card selector because of other aspects such as aesthetics, higher familiarity or preference of the players, dealers or casino owners for mechanical devices.

The method then comprises the step of calculating a payout when a payout-determining card matches one of the cards identified by a bet from a player 84.

By comparing the outcome of the random event i.e. the payout-determining card with the cards identified by bets made by players, the wins and the losses of the game are resolved according to the payout table. The predetermined payout charts determine the amount of payout.

In the preferred embodiment, the dealer compares the result of the outcome of the random event i.e. the payout-determining card with the cards identified by bets from players, calculates the amount of payout determined by the predetermined payout chart and resolves the wins and losses of the players.

The payout amount is calculated by multiplying an amount of a winning bet made by a player by the winning bet payout multiplication factor of the corresponding bet. The amount paid to the player corresponds to the payout amount added with his or her bet amount.

For example, a player made a <<split bet>> identifying two betting cards for example <<ace>> and <<two>> of <<spade>> and bet amount of $10.00. The randomly drawn payout-determining card is the <<ace of spade>>. The <<split>> bet on the <<ace>> and <<two>> of <<spade>> is a winning bet. A payout amount is calculated by multiplying the amount of the winning <<split>> bet identified by the player i.e. $10.00 by the corresponding payout multiplication factor corresponding to a winning <<split>> bet i.e. 23, for a payout amount of $230.00 for the player. The player receives the total amount of $240.00.

Finally, the method comprises the step of crediting player with the payout 86.

The amount of the payout can be credited to players in cash, tokens, chips, tickets, goods, services or any objects to which a monetary value can be attributed.

In preferred embodiments, the dealer takes from the bank and gives to the players a number of makers, chips or tokens corresponding to the calculated payout amount and returns to the player the bet amount wagered by the player.

It is to be understood that, when the game is played on an electronic support such as a slot machine, a video game or with an electronic player wagering console, credits can be on an electronic support instead of material credit support such as markers, tokens or chips.

Referring now to FIG. 4, which is a representation of the surface game of the present invention, the 54 squares are shown wherein 48 squares are laid out in 12 staked rows of 4 adjacent squares. Each square represents one of the 54 cards, which compose a 54 playing card deck. The 6 cards identified as <<outside>> cards (i.e. <<free turn>> cards or <<all bets lose>> cards) or as <<all outside bets lose>> cards are, in a preferred embodiment, the jokers 89 and 91, the seven of heart 88, the seven of clubs 90, the seven of diamonds 92, and the seven of spade 94. A player can wager on betting options usually offered in a classical roulette game: <<straight up>> 96, <<splits>> 98, <<line>> 100, <<square>> 102, <<dozen>> 106; <<column>> 114; <<red>> or <<black>> 110 <<odd>> or <<even>> 116*a*, 116*b* and <<lows>> or <<highs>>, 112.

In addition to typical classic roulette betting options, players can bet on additional betting options, such as a card suit: <<spade>> 118; <<diamond>> 120, <<club>> 122, or <<heart>> 124; or a <<24 card block>> such as: <<first 24 cards block>> 126*a* or <<second 24 cards block>> 126*b*. Also, eight additional squares numbered 1 to 8 and representing player positions 108 give players an opportunity to make additional bets. It is understood that the number of players and the number corresponding to the position squares can be smaller or larger.

Figure 5:
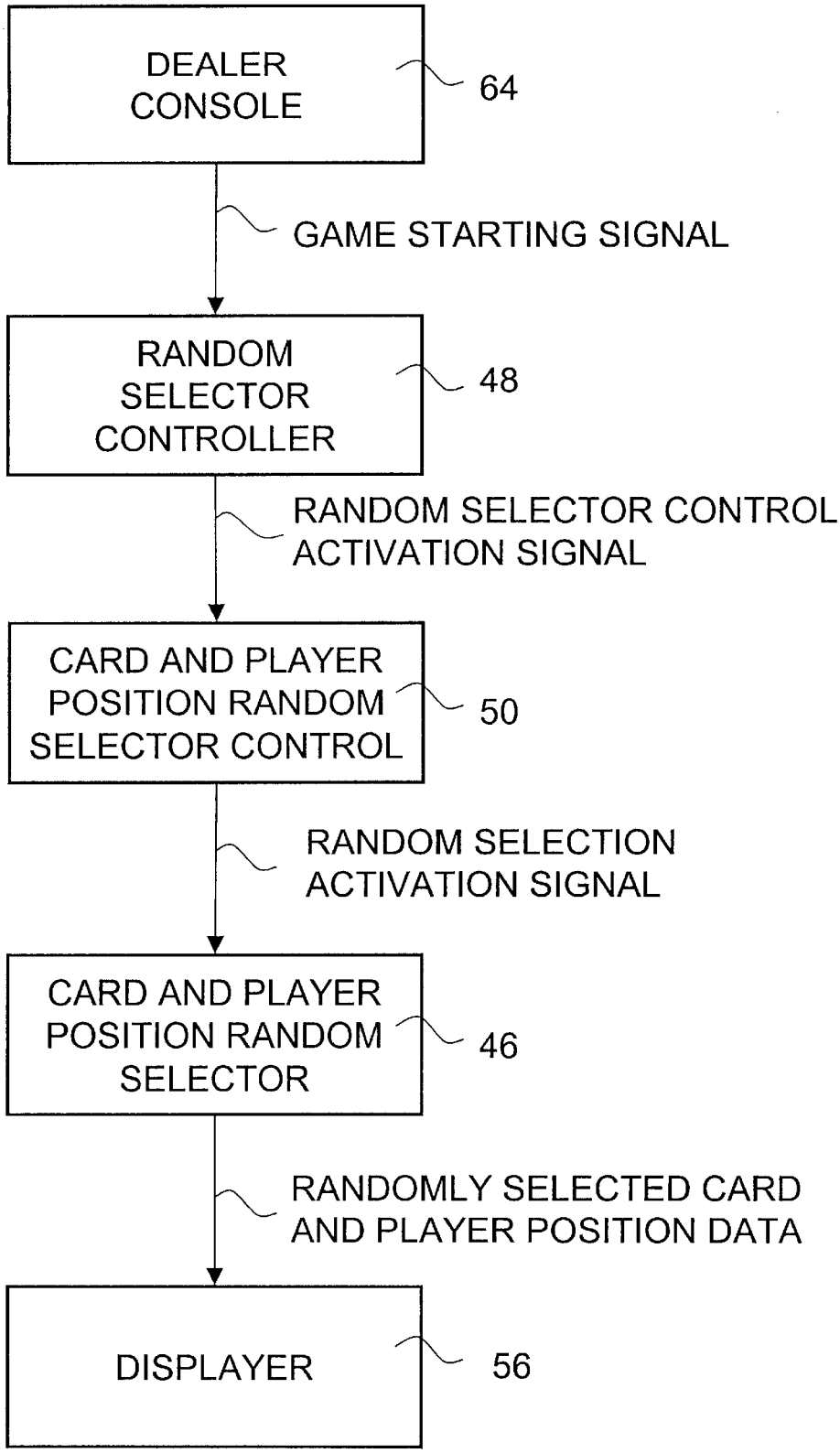
FIG. 5 is a block diagram of the apparatus of the present invention.

Referring back to FIG. 1, the steps of the preferred embodiment will be described more in detail. The dealer 38 invites players 40 to choose among the different betting options and to wager on the game surface 44. The players, with the help of colored chips, wherein each color is assigned to one player, select betting options and amounts by placing, on the game surface 44 layout, a number of chips on the corresponding card squares or on the intersection of rows and/or columns to signify a bet on a number or a group of numbers or on squares representing a player position. The dealer 38 calls for the end of the betting period. Referring now to FIG. 5, the dealer enters the game starting operation data into the dealer console 64. The dealer console 64 sends a game-starting signal to the random card and player position selector controller 48. The random selector controller, sends an activation signal, and activates the card and player position random selector control 50. The dealer 38, or a designated player 40, starts the position and card random selection process via a random card and player position selector control 50 which is connected to the random card and player position selector 46. The randomly selected card and position data are sent to the display 56 that displays the randomly chosen payout-determining card and player position. In comparing the final outcome of a game, the randomly selected card, the randomly selected player position displayed by the display 56, and the betting options chosen by players, the dealer resolves the wins and losses according to the payout charts.

Figure 6A:
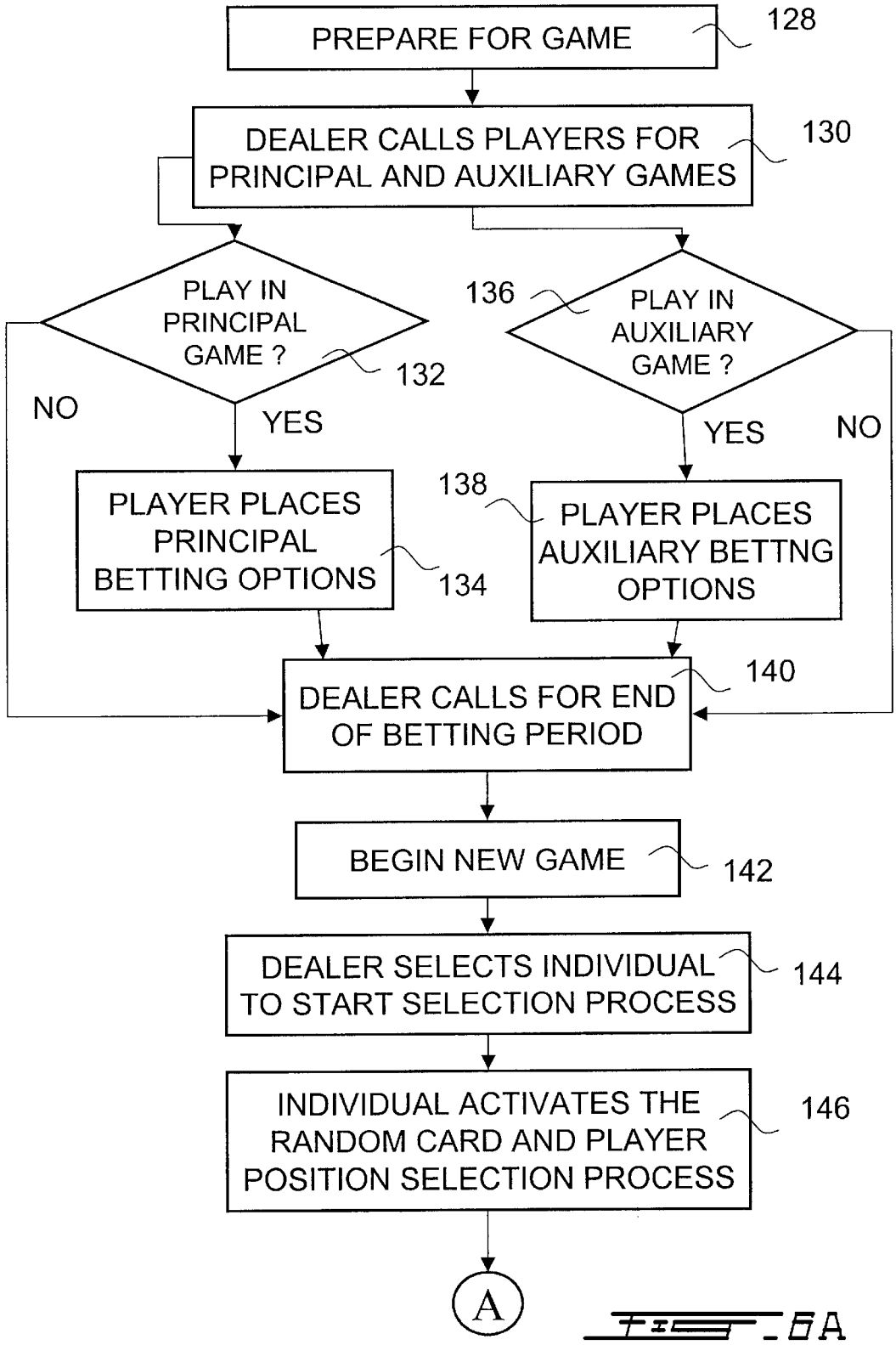
FIGS. 6A, 6B and 6C are combined to form a flow chart representing the steps and two alternative methods of playing at the game of the present invention with or without randomly selected auxiliary prize.
Figure 6B:
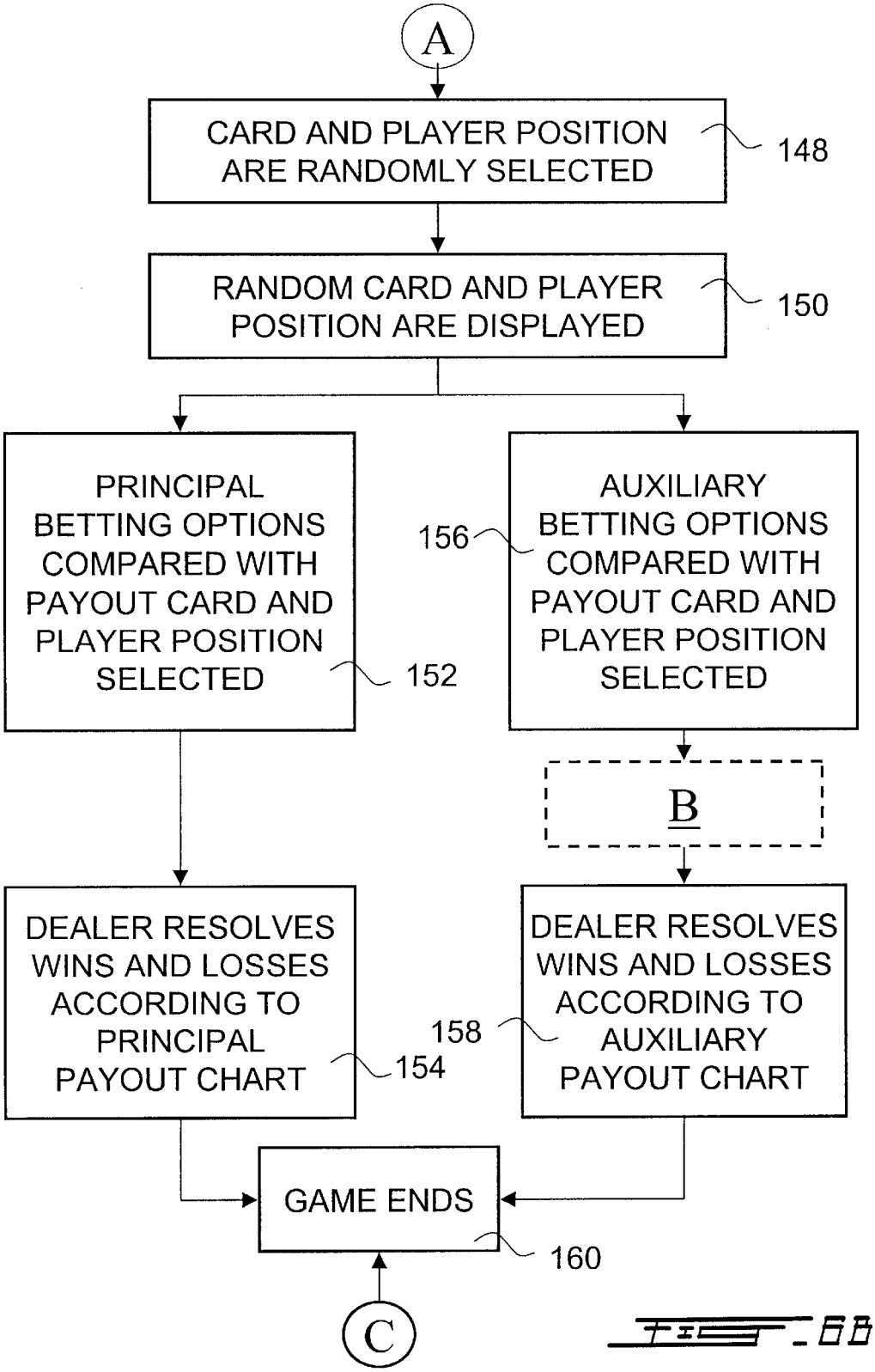

FIG. 6A and FIG. 6B, are joined to form a flow chart, which represents the steps of a method of playing the game of the present invention without randomly selected auxiliary prizes. The dealer and players first prepare for playing the game 128. The step may include clearing the table of wagers, tokens, markers or chips from previous games and letting players take their position for participating in a new game. The dealer calls players to participate in a new game; which may include one or both of a principal and an auxiliary game 130. Players interested in playing indicate their willingness and betting choices by placing markers, chips or tokens on card areas or on intersections of rows and/or columns.

In this preferred embodiment, the auxiliary game is a bet on the player position that will be chosen by the random selector. It will be understood that other auxiliary games could be played.

According to the present method, players may decide to participate in principal and auxiliary games independently or in combination. A player that decides to participate in the principal game 132, indicates his or her participation by positioning principal betting selections 134 with the help of chips, markers or tokens, on the game surface layout 44.

A player who decides to participate in an auxiliary game 136 places his or her auxiliary betting selections 138 by making an auxiliary bet on at least one of eight (8) additional areas numbered from 1 to 8 108 each one representing a player position.

After allowing the to players to bet on the principal and auxiliary games, the dealer calls for the end of the betting period 140.

A new game begins 142. The dealer selects an individual who will start the random card and player position selection process 144. A designated individual, the dealer or one of players activates a signal for starting a random card and position selection process 146. The activation operation and the signal sent, take various forms age depending on apparatus used as random selectors.

For example, when the selection apparatus is a mechanical wheel, the activation operation consists in spinning the wheel and the signal is the ball launched into the spinning wheel. In the case of an electromechanical shuffler or an electronic random card selector, the activation operation is to begin the random generation process, and the activation signal is an electric signal started in activating a switch or button. The switch can be a footswitch, an electromechanical lever switch, a wired electric switch, an unwired electromagnetic switch, etc.

In the present embodiment, the card and player position random selector control 50 is an electromagnetic wired switch connected to the random card selector, and random player position selector 46, so that, in sending the random activation signal, the two processes take place at same time.

In the present embodiment, the switch takes the form of a slap button. When pressed, it sends a signal to the random card and random player position selector 46, for executing a random card and player position selection.

During a random selection process, the display 56 can display multiple changing cards and player positions accompanied with some sounds to enhance the excitement among players.

As soon as a card and a player position have been randomly selected 148 by the random card and player position selector 46, the selected card and player position are immediately displayed 150 on one or a plurality of screens 54, 52 of the display 56 for enabling dealer and players to see the random outcome events.

By comparing and matching the randomly selected card and player principal betting selections 152 indicated on the game surface layout 8, the dealer determines wins and losses according to the principal game payout chart 154.

For illustration purposes, two payout charts among a plurality of possible payout charts are provided herein: TABLE 4 is used preferably if the principal game uses exclusively a single <<free turn>> card (or <<happy card>> such as the seven of heart. TABLE 5 is preferably used if the principal game uses two <<free turn>> cards (or <<happy cards>>), such as the seven of heart and the seven of spade.

TABLE 4

| Principal Game Payout Chart | |
|---|---|
| Seven of heart (7♥) | Free Turn |
| Seven of club (7♣) or seven of spade (7♠) or seven of diamond (7♦) | All Outside Bets Lose |
| 1 Straight Card Bet pays | 48 (47 to 1) |

TABLE 4-continued

| Principal Game Payout Chart | |
|---|---|
| 2 Split Cards Bet pays | 24 (23 to 1) |
| 4 Line Cards Bet pays | 12 (11 to 1) |
| 4 Corner Cards Bet pays | 12 (11 to 1) |
| 8 Line Cards Bet pays | 6 (5 to 1) |
| 12 Block Cards Bet pays | 4 (3 to 1) |
| 24 Block Cards Bet pays | 2 (1 to 1) |
| 12 Column Cards Bet pays | 4 (3 to 1) |
| Kind Bet (i.e. ♠, ♣, ♥, ♦) pays | 4 (3 to 1) |
| Red and Black Bet pays | Even Money |
| Odd (i.e. A, 3, 5, 9, J, K) Bet or Even (i.e. 2, 4, 6, 8, 10, Q) Bet pays | Even Money |
| High (i.e. 8, 9, 10, J, Q, K) Bet or Low (i.e. A, 2, 3, 4, 5, 6) Bet pays | Even Money |

TABLE 5

| Principal Game Payout Chart | |
|---|---|
| Seven of heart (7♥) or seven of spade (7♠): | Free turn |
| Seven of club (7♣) or seven of diamond (7♦): | All outside bets lose |
| 1 Straight Card Bet pays: | 48 (47 to 1) |
| 2 Split Cards Bet pays: | 24 (23 to 1) |
| 4 Line Cards Bet pays: | 12 (11 to 1) |
| 4 Corner Cards Bet pays: | 12 (11 to 1) |
| 8 Line Cards Bet pays: | 6 (5 to 1) |
| 12 Block Cards Bet pays: | 4 (3 to 1) |
| 24 Block Cards Bet pays: | 2 (1 to 1) |
| 12 Column Cards Bet pays: | 4 (3 to 1) |
| Kind Bet (i.e. ♠, ♣, ♥, ♦) pays: | 4 (3 to 1) |
| Red and Black Bet pays: | Even money |
| Odd (i.e. A, 3, 5, 9, J, K) Bet or Even (i.e. 2, 4, 6, 8, 10, Q) Bet pays: | Even Money |
| High (i.e. 8, 9, 10, J, Q, K) Bet or Low (i.e. A, 2, 3, 4, 5, 6) Bet pays: | Even Money |

In addition, by comparing and matching the randomly selected player position and card displayed with the player auxiliary betting selections 156, the dealer determines wins and losses using the auxiliary payout chart 158.

For illustration purposes, two possible auxiliary payout charts among many are presented. TABLE 6 is preferably used if, in the principal game, a single <<free turn>> card (or <<happy card>>) is used, such as the seven of heart. TABLE 7 is preferably used, applies if two (2) <<free turn>> cards (or <<happy cards>>) are used in the principal casino game, such as the seven of heart and the seven of spade.

TABLE 6

| Auxiliary Payout Chart | |
|---|---|
| Seven of heart (7♥) and Player Position Bet pays | 100 (99 to 1) |
| Seven of heart (7♥) Card Bet pays | 25 (24 to 1) |
| Player Position Bet Only pays | 2 (1 to 1) |

TABLE 7

| Auxiliary Payout Chart | |
|---|---|
| Seven of heart (7♥) or seven of spade (7♠) and Player Position Bet pays | 30 (29 to 1) |
| Seven of heart (7♥) or seven of spade (7♠) without Player position bet pays | 15 (14 to 1) |
| Player Position Bet Only pays | 2 (1 to 1) |

Then, when the dealer has determined the wins and losses, the game ends 160.

Also, in conjunction with the randomly selected player position and card, another random feature, such as a random auxiliary prize selection can also be added.

One way to include an auxiliary randomly selected prize is by offering the opportunity, upon the occurrence of a predetermined random event in the auxiliary game, to start a random prize selection. The opportunity of winning an auxiliary randomly selected prize allows to give larger payouts.

By comparing the player auxiliary betting option with the card and player position randomly selected, a matching between a predetermined event in the principal game, such as the occurrence of a <<free turn>> card (or <<happy card>>) and a player position, and a player auxiliary betting options, give to the player the eligibility to win a randomly selected auxiliary prize.

Figure 6C:
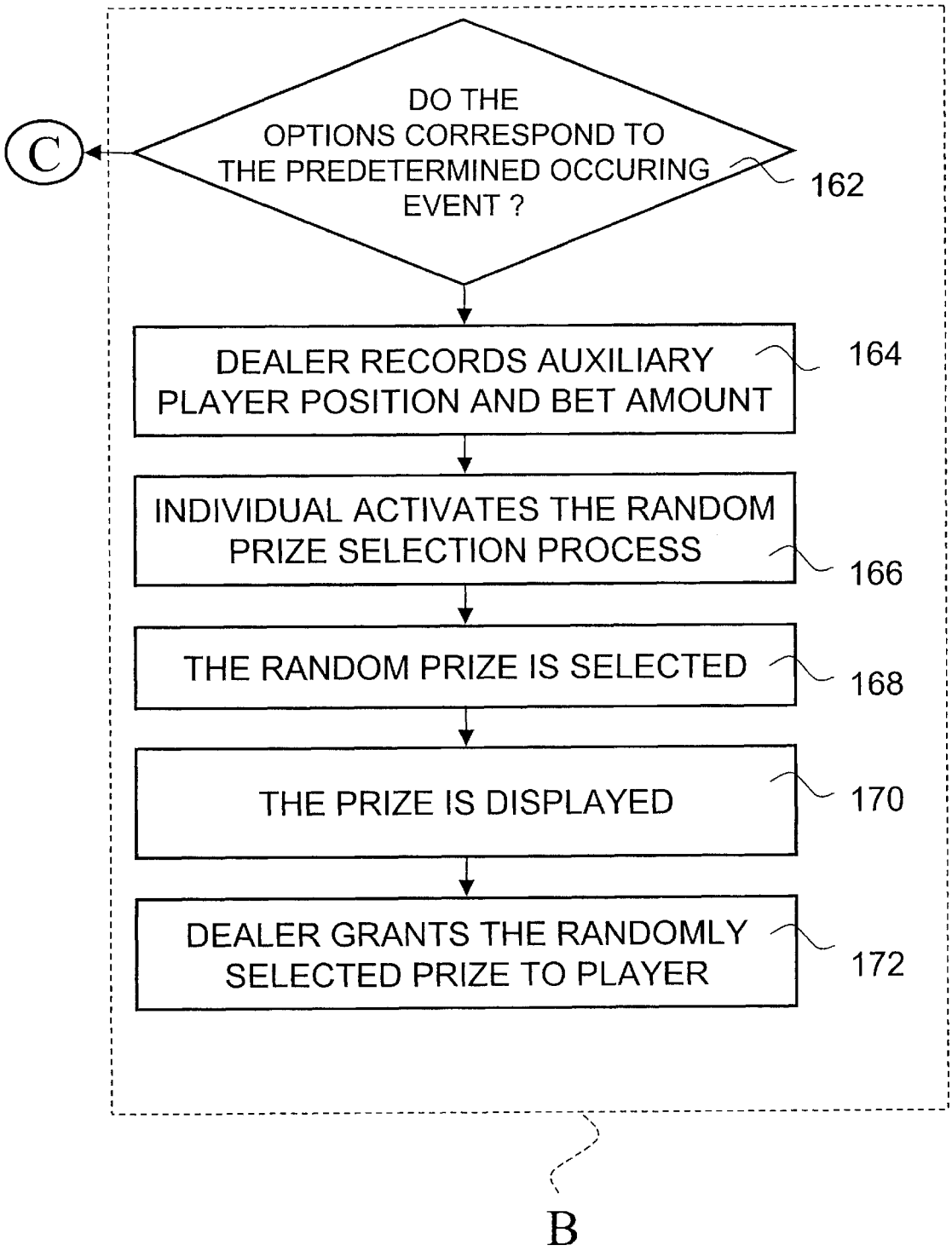
Figure 7:
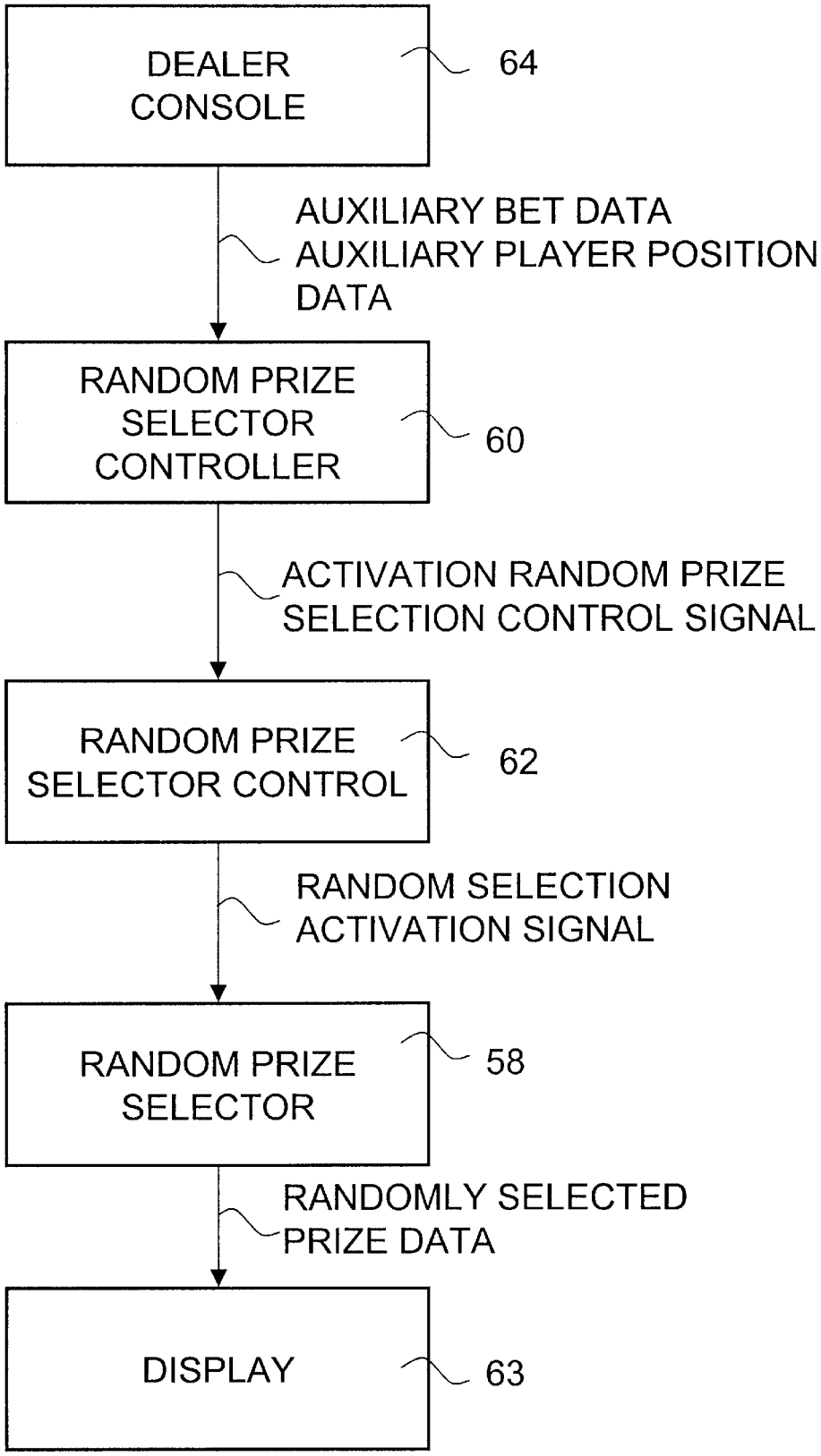
FIG. 7 is a block diagram of the apparatus for granting a randomly selected auxiliary prize.

Referring now to FIG. 7 which is a block diagram of the apparatus for granting a randomly selected auxiliary prize according to the present invention and FIG. 6C which is a flow chart representing the steps of a method of playing the game of the present invention with a randomly selected auxiliary prize.

From the comparison of the player auxiliary betting option data and the card and player position selected in the principal game 126, the dealer 38 can determine if none, one or some player auxiliary betting options correspond to predetermined occurring events in the auxiliary game 162 which give opportunities of randomly selecting an auxiliary prize.

If a match happens between the predetermined auxiliary event and one or more of the player auxiliary betting options, then the dealer 8 records the auxiliary player position and the auxiliary bet amount corresponding to each the corresponding player 164, into the dealer console 64. Then, the auxiliary bet data and player position data are transmitted to the random prize selector controller 60. at the same time, the random prize selector controller 60 sends an activation random prize selection control signal and triggers the random prize selector control 62. Upon this trigger set in function, an indication is produced for communicating the actual activation of the random prize selector control 62. In the present embodiment, the indication is a visual indication means, such as a light 69. It is understood that the indication can take other embodiments and can be associated with audible, visual or sensing effects.

Upon the designation of the dealer, the auxiliary winning identified player 166 activates the random prize selection process 22 via the selector random prize selector control 12. The random prize selected 168 is displayed after a short moment on the random prize display 63. According to the randomly selected auxiliary prize displayed 170, the dealer grants the randomly selected prize 172 and resolves the wins and losses along the auxiliary paying chart 158. Then the game ends 160.

In a preferred embodiment, by comparing matches between a predetermined auxiliary event and a randomly selected player position, selected card and the auxiliary bets, the dealer resolves wins and losses along the auxiliary payout chart and determines if there is any winning auxiliary players. Then, to determine an auxiliary random prize, the dealer enters, on the dealer console 10, the auxiliary bet amount of the winning auxiliary player. The dealer invites the winning auxiliary player, if any, to slap on the second slap button 22. By punching the button 22, a random selection process of the winning prize in the auxiliary game is started. On the random prize display, 63, a random selected prize is displayed on one of screens 65 or 67. On the other screen, for example on screen 65, the auxiliary bet made by the winning auxiliary player, and entered on the console by the dealer, is displayed. A short period after, the total prize corresponding to the multiplication of the random selected prize by the corresponding auxiliary bet, is displayed on the first screen, 67. In addition, an optional happy face or other symbol can randomly appear on the second screen, 65.

If a happy face appears on a second screen, a special prize is awarded to the winning auxiliary player in addition of the total prize displayed. The bonus prize can take many embodiments: a certain number of special chips, tokens or markers that constitute an entry in a future grand tournament between many casinos, an entry ticket for a special gaming event or any types of prizes such as a car, a trip or a monetary amount.

As it will be appreciated by a person skilled in the art, the method and system of the present invention could be totally or partially connected to any other electronic apparatus, device or system enabling the creation of the enhanced principal and auxiliary games played by a plurality of players from a plurality of local or remote physical locations such as various casinos, hotels, houses etc.

Although the present invention has been explained herein above by way of preferred embodiments thereof, it should be noted that any modifications to these preferred embodiments within the scope of the appended claims is not deemed to alter or change the nature and scope of the present invention.

What is claimed is:

1. A method of playing a casino table game comprising:

displaying cards from a deck of playing cards as betting cards, wherein said playing cards have at least one of an integer value, a face value, a suit, a color and a parity;

recording at least one gaming bet from a player, wherein said player chooses a number n of said betting cards for each of said at least one gaming bet;

recording a securing bet from said player, wherein said player chooses a number s of said playing cards as bet securing cards, wherein said bet securing cards allow said player to modify a casino house income ratio;

drawing at random from said deck of playing cards a payout-determining card wherein said payout determining card is any one card of said deck of playing cards;

using said payout-determining card, calculating a payout for each of said at least one gaming bet, for said player, said payout amounting to 48/n when said payout-determining card matches one of said betting cards chosen, and said payout amounting to zero when said payout-determining card does not match any of said betting cards chosen;

wherein when said payout-determining card matches one of said s bet securing cards chosen by said player, a payout of zero is calculated for said player and said gaming bet identifying a number n of playing cards made by said player is returned to said player.

2. The method as claimed in claim 1, wherein said gaming bet is only recorded when 48/n is an integer, said payout being an integer amount.

3. The method as claimed in claim 1, wherein said number n of said betting cards represents all of said betting cards of a same face value.

4. The method as claimed in claim 1, wherein said number n of said betting cards represents all of said betting cards in a same suit.

5. The method as claimed in claim 1, wherein said number n of said betting cards represents all of said betting cards in one of:

a same face value; and a same suit.

6. The method as claimed in claim 1, wherein said number n of said betting cards represents all of said betting cards in one of:

a same range of face values;

a same color; and a same parity.

7. The method as claimed in claim 1, wherein said number n of said betting cards represents all betting cards in one of:

a same face value;

a same suit;

a same range of face values;

a same color; and a same parity.

8. The method as claimed in claim 1, further comprising identifying at least one card not chosen as betting cards from said deck of playing cards as at least one outside card.

9. The method as claimed in claim 8, wherein at least one of said at least one outside card is an all bets lose card, wherein a payout of zero is calculated for said player when said all bets lose card is drawn.

10. The method as claimed in claim 8, wherein at least one of said at least one outside card is a free turn card, wherein said gaming bet is returned to said player when said free turn card is drawn.

11. The method as claimed in claim 8, wherein said gaming bet is only recorded when 48/n is an integer, said payout being an integer amount.

12. The method as claimed in claim 11, wherein said at least one outside card is one card from each of four of said suits and said number n=12 of said betting cards chooses all of said betting cards in a same suit.

13. The method as claimed in claim 11, wherein said at least one outside card is four cards of odd parity so that said number n=24 of said betting cards identifies all of said betting cards of same parity.

14. The method as claimed in claim 11, wherein said at least one outside card is four cards of a same face value so that said number n=24 of said betting cards identifies all of said betting cards in a same range of face values of one of two ranges of face values lower or higher than face value 7.

15. The method as claimed in claim 11, wherein said at least one outside card is four cards having a face value of 7 and two jokers from a deck of fifty-four playing cards.

16. The method as claimed in claim 1, further comprising providing a game surface having areas corresponding to said cards and arranged in a geometric pattern.

17. The method as claimed in claim 16, wherein said number n of cards is identified by a geometrical characteristic of said game surface geometric pattern.

18. The method as claimed in claim 17, further comprising positioning a betting marker on a betting area identifying said geometrical characteristic on said game surface geometric pattern wherein said betting areas make up a play board.

19. The method as claimed in claim 18, wherein said number n is selected such that 48/n is an integer.

20. The method as claimed in claim 19, further comprising identifying two or more of said betting areas by positioning said betting marker, wherein said marker is positioned to sit on a border between two or more said betting areas.

21. The method as claimed in claim 8, further comprising identifying at least one card of said outside cards as an all outside bets lose card.

22. A method of playing a casino roulette table game comprising:

displaying numbers from a set of roulette numbers, including roulette numbers 1 to 36, 0 and 00, as betting numbers;

recording at least one gaming bet from a player, wherein said player chooses a series n of said betting numbers for each of said at least one gaming bet;

recording a securing bet from said player, wherein said player chooses a series s of said betting numbers as bet securing numbers, wherein said bet securing numbers allow said player to modify a casino house income ratio;

drawing, at random, from said set of roulette numbers, a payout-determining number, wherein said payout determining number is any one of said roulette numbers;

using said payout determining number, calculating a payout for each of said at least one gaming bet for said player, said payout amounting to 36/n when said payout-determining number matches one of said n betting numbers chosen, and said payout amounting to zero when said payout-determining number does not match any of said betting numbers chosen.

23. The method as claimed in claim 22, wherein when said payout-determining number matches one of said s bet securing numbers chosen by said player, a payout amounting to zero is calculated for said player and said gaming bet identifying a number n of betting numbers made by said player is returned to said player.

* * * * *